US008632147B2

(12) United States Patent
Onishi

(10) Patent No.: US 8,632,147 B2
(45) Date of Patent: Jan. 21, 2014

(54) METHOD FOR OBTAINING REACTION SOLUTION DOT SHAPE INFORMATION

(75) Inventor: Toru Onishi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 259 days.

(21) Appl. No.: 13/046,536

(22) Filed: Mar. 11, 2011

(65) Prior Publication Data

US 2011/0221808 A1 Sep. 15, 2011

(30) Foreign Application Priority Data

Mar. 15, 2010 (JP) ..... 2010-057727

(51) Int. Cl.
*B41J 29/38* (2006.01)
*B41J 2/01* (2006.01)

(52) U.S. Cl.
USPC ..... 347/9; 347/14; 347/16; 347/103

(58) Field of Classification Search
USPC ..... 347/9, 14, 103, 16
See application file for complete search history.

(56) References Cited

U.S. PATENT DOCUMENTS

2005/0116978 A1* 6/2005 Kubota ..... 347/19
2009/0027473 A1* 1/2009 Taniuchi et al. ..... 347/103

FOREIGN PATENT DOCUMENTS

JP 2002-370441 A 12/2002

* cited by examiner

*Primary Examiner* — Jason Uhlenhake
(74) *Attorney, Agent, or Firm* — Canon USA Inc. IP Division

(57) ABSTRACT

A reaction solution dot shape information obtainment method to be employed for a transfer type inkjet recording method including applying a reaction solution to aggregate a color material component contained in an ink onto an image forming surface of an intermediate transfer member, forming an intermediate image by applying the ink containing the color material component onto the image forming surface of the intermediate transfer member onto which the reaction solution is applied, and forming an image by transferring the intermediate image from the image forming surface to a recording medium by pressing the recording medium to the image forming surface on which the intermediate image is formed, includes measuring a shape of an ink dot of the intermediate image formed on the image forming surface of the intermediate transfer member or the image transferred onto the recording medium, and obtaining shape information of a reaction solution dot from a measurement result of the ink dot shape.

4 Claims, 8 Drawing Sheets

| RELATIONSHIP BETWEEN REACTION SOLUTION DOT AND INK DOT | (1) DISTANCE BETWEEN ENTERS = 0 | (2) DISTANCE BETWEEN CENTERS = (INK DOT RADIUS + REACTION SOLUTION DOT RADIUS) × 3/4 |
|---|---|---|
| (a) REACTION SOLUTION DOT DIAMETER = INK DOT DIAMETER × 0.5 |  |  |
| (b) REACTION SOLUTION DOT DIAMETER= INK DOT DIAMETER × 2 |  |  |

METHOD FOR OBTAINING REACTION SOLUTION DOT SHAPE INFORMATION

BACKGROUND OF THE INVENTION

1. Field of the Invention

The present invention relates to reaction solution dot shape information obtainment method to be employed for a transfer type inkjet recording method.

2. Description of the Related Art

As one of printing methods, a recording method (transfer type inkjet recording method), in which an intermediate image is formed by discharging an ink by an inkjet recording method onto an intermediate transfer member to which a reaction solution is applied, and a final image is formed by transferring the formed intermediate image onto a recording medium, has been known. In the transfer type inject recording method, when a large amount of the reaction solution, particularly, the reaction solution in such an amount that exceeds a diameter of one ink dot to be formed on the intermediate transfer member, is applied onto the intermediate transfer member, a force by which the intermediate image adheres to the intermediate transfer member is reduced, which sometimes disturbs the transferred image. Therefore, in the transfer type inkjet recording method, it is important to apply the reaction solution in an amount that is sufficient to avoid a reduction in viscosity or an aggregation effect.

Japanese Patent Application Laid-Open No. 2002-370441 discusses a transfer type inkjet recording method, wherein an application amount of a reaction solution is reduced to be less than an application amount of an ink by reducing a discharge amount per dot of the reaction solution or performing intermittent discharge of the reaction solution.

In the transfer type inkjet recording method, it is necessary to bring the applied reaction solution and the ink into contact with each other without fail on an image forming surface of the intermediate transfer member. Since the image forming surface of the intermediate transfer member has high ink releasability in the transfer to the recording medium, the reaction solution is prevented from easily wetting and spreading on the image forming surface of the intermediate transfer member. As a result, when the application amount of the reaction solution is reduced as discussed in Japanese Patent Application Laid-Open No. 2002-370441, there is a possibility that a part in which the reaction solution and the ink do not contact with each other is generated due to repelled reaction solution or landing position shift between the reaction solution and the ink on the image forming surface of the intermediate transfer member. When the reaction solution and the ink do not contact with each other, the part becomes a region in which the ink and the reaction solution do not react with each other. An image of the non-reaction region is disturbed in the transfer, which causes image deterioration in some cases. Therefore, an application amount of the reaction solution can be optimized based on a state of the applied reaction solution if the state of the applied reaction solution is detected. Particularly, since the intermediate transfer member moves a lot in the transfer type inkjet recording method, a dot shape of the reaction solution before the application of the ink is a considerably important element in terms of its influences on the image.

However, since the reaction solution is ordinarily colorless and transparent, it has been difficult to obtain dot shape information of the reaction solution before the ink application.

SUMMARY OF THE INVENTION

Aspects of the present invention are directed to favorably obtaining dot shape information of a reaction solution on an intermediate transfer member.

According to an aspect of the present invention, there is provided a reaction solution dot shape information obtainment method to be employed for a transfer type inkjet recording method including reaction solution application of applying a reaction solution for aggregating a color material component contained in an ink onto an image forming surface of an intermediate transfer member, intermediate image formation of forming an intermediate image by applying the ink containing the color material component onto the image forming surface of the intermediate transfer member onto which the reaction solution is applied, and transfer of forming an image by transferring the intermediate image from the image forming surface to a recording medium by pressing the recording medium to the image forming surface on which the intermediate image is formed, including measuring a shape of an ink dot of the intermediate image formed on the image forming surface of the intermediate transfer member or the image transferred onto the recording medium, and obtaining shape information of a reaction solution dot from a measurement result of the ink dot shape.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

According to aspects of the present invention, based on a result obtained by measuring a shape of an ink dot, reaction solution dot shape information can be obtained which is ordinarily difficult to obtain due to a colorless and transparent reaction solution. Further, it is possible to attain satisfactory contact between the reaction solution and an ink as well as to obtain an ink dot having a predetermined shape by changing application of the reaction solution by feeding back the obtained reaction solution dot shape information to the reaction solution application.

First, a transfer type inkjet recording method employing the reaction solution dot shape information obtainment method according to aspects of the present invention will be described.

Figure 1:
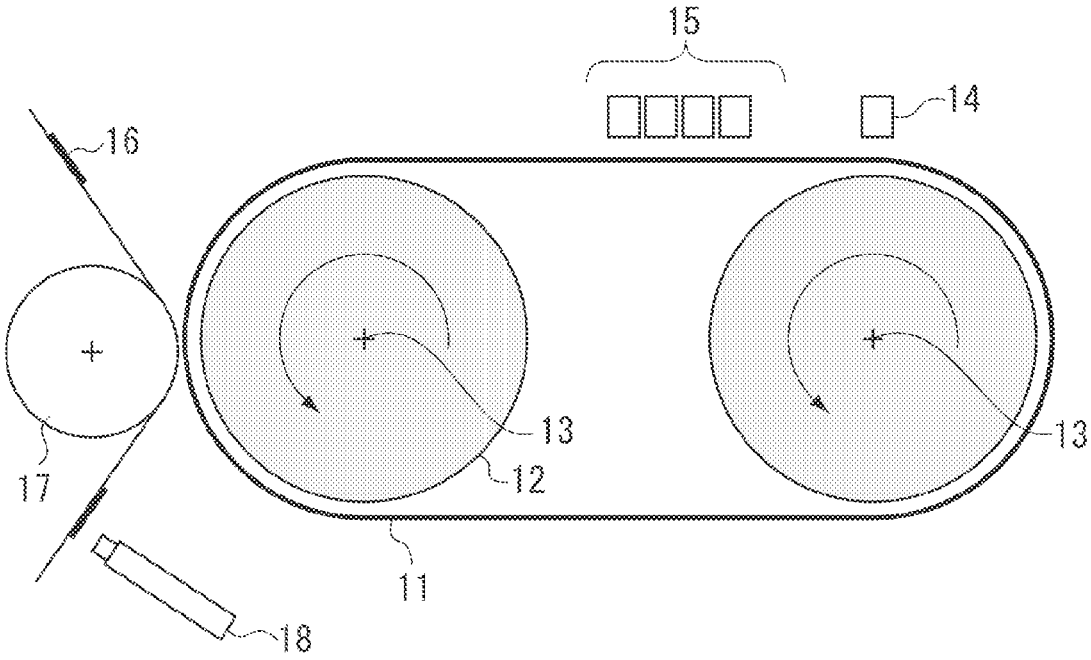
FIG. 1 is a diagram illustrating a transfer type inkjet recording apparatus.

The transfer type inkjet recording method will be described with reference to FIG. 1. FIG. 1 is a diagram illustrating a transfer type inkjet recording apparatus. An intermediate transfer member 11 is fixed to a surface of a belt rotating along two rotatable columnar support members 12. Each of the support members 12 rotates about a shaft 13 in a direction of an arrow, and devices disposed around the support members 12 are activated in synchronization with the rotation. The support members 12 are rotated when a motor is driven in response to a signal from a motor driver (not illustrated).

The intermediate transfer member 11 may have properties of temporarily receiving an ink and successfully transferring a formed intermediate image onto a recording medium. Particularly, the higher transfer property, the better ink use efficiency, and cleaning property in repetitive use is also improved. Therefore, a surface of the intermediate transfer member may be the one which does not absorb ink, such as a non-adhesive surface. Further, to cause the intermediate transfer member to follow and satisfactorily contact a surface of a recording medium such as a paper sheet, it is effective to impart elasticity to the intermediate transfer member 11. Examples of a material that satisfies the above-described properties include various plastics and rubbers. Particularly, from the viewpoint of non-adhesive property, a silicon rubber, a fluorosilicon rubber, and a fluorine rubber may have such properties. More specifically, a material obtained by coating a polyester (PET) sheet with a silicon rubber may be used for the intermediate transfer member.

First, a reaction solution application step is performed. In the step, a reaction solution is applied onto the image forming surface of the intermediate transfer member using a reaction solution application unit. An inkjet head device 14 is used herein as the reaction solution application unit, but a coating roller or the like may alternatively be used. Next, an intermediate image formation step is performed. In the step, an intermediate image is formed, using an ink application unit, by applying the ink containing a color material component on the image forming surface of the intermediate transfer member to which the reaction solution is applied. An inkjet head device 15 is used as the ink application unit. Next, a transfer step is performed. In the step, an image is formed by transferring the intermediate image onto a recording medium 16 using a transfer unit by pressing the recording medium 16 to the image forming surface on which the intermediate image is formed. A pressure roller 17 is used as the transfer unit.

In the transfer type inkjet recording method, the image is formed on the recording medium as described above. Though a cleaning unit and a drying mechanism are not illustrated in FIG. 1, those may appropriately be provided for the intermediate image and the intermediate transfer member after the transfer, for example.

Hereinafter, a reaction solution dot shape information obtainment method will be described. The inventors noted on the following phenomenon caused depending on a size of each of an ink dot of the image formed on the image forming surface of the intermediate transfer member or the image transferred onto the recording medium and reaction solution dots, and a distance between centers of each dots. Aspects of the present invention provides a method for obtaining shape information of a reaction solution dot which is colorless and transparent by measuring a shape of the ink dot of the intermediate image formed on the image forming surface of the intermediate transfer member or the image transferred onto the recording medium utilizing the phenomenon and based on a result of the measurement of the ink dot shape.

Figure 2:
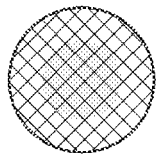
FIG. 2 is a diagram illustrating a relationship between a reaction solution dot and an ink dot.
Figure 2:
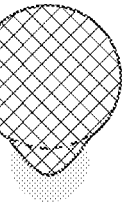
Figure 2:
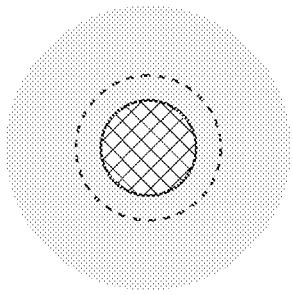
Figure 2:
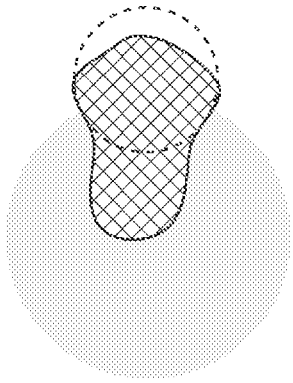

Illustrated in FIG. 2 is a difference of ink dot shapes on the image forming surface of the intermediate transfer member, which is generated depending on sizes of the reaction solution dot and the ink dot and position relationship therebetween. The painted portion indicates the reaction solution dot, and a shaded portion indicates the ink dot. A broken line indicates an ideal ink dot shape, and a solid line indicates an actual ink dot shape after a reaction. In FIG. 2, a reaction solution dot diameter is a half of an ink dot diameter under Condition (a). A reaction solution dot diameter is twice the size of an ink dot diameter under Condition (b). A distance between centers of a reaction solution dot and an ink dot is 0 (the centers are identical to each other) under Condition (1). A reaction solution dot and an ink dot contact with each other, and a distance between centers thereof is ¾ times of a sum of radii thereof (centers are not identical to each other) under Condition (2).

As illustrated in Condition (b)-(2) of FIG. 2, when the reaction solution dot is large and the distance between the centers of the reaction solution dot and the ink dot is large, the following two forces are generated. One of the forces is a flowing force of the color material in such a manner that apparent deviation of a color material concentration in the ink caused by aggregation of the color material of the ink is averaged. And the other is a force of change into a spherical shape by a surface tension. By the two forces, the ink is attracted to the reaction solution to cause an ink dot center position shift and a reduction in roundness caused by distortion of the ink dot shape. As indicated by a comparison between Conditions (a)-(2) and (b)-(2), since an influence n the ink is reduced along with a reduction in diameter of the reaction solution dot, the ink dot center position shift and the shape distortion are reduced when the reaction solution dot diameter is small.

As indicated by Condition (b)-(1), when the ink lands on the reaction solution dot having the diameter that is larger than the ink dot diameter, the reaction solution prevents the landed ink from spreading, resulting in formation of the ink dot having the small diameter.

Based on the above-described findings, the inventors could obtain shape information of the reaction solution dot by measuring the shape of the ink dot of the intermediate image formed on the image forming surface of the intermediate transfer member or the image transferred onto the recording medium.

Hereinafter, the reaction solution dot shape information obtainment method according to aspects of the present invention will be more specifically described. Referring back to FIG. 1, after the transfer of the image onto the recording medium 16, imaging of the transferred image is performed by an imaging unit 18. The imaging unit 18 obtains image data in synchronization with stroboscopic illumination (not illustrated) to make it possible to perform imaging in the recording medium that is conveyed at a high speed. Also, the imaging unit 18 slides in a vertical direction of the drawing sheet of FIG. 1 to perform the imaging in combination with the paper sheet conveyance and, thus, is capable of imaging an entire surface of a printing range.

It may be the case that each ink dot has a discrete pattern to obtain shape information of a reaction solution dot. And it may be the case that image data is used that is obtained by inputting a specific inspection pattern in which the discrete pattern is formed on an entire region of the image forming range. In the case of using the inspection pattern, a recording medium conveyance speed may be reduced, and shapes of ink dots in an entire printing range of one image may be measured to minimize a use amount of a recording medium and an ink.

As to the shape of the ink dot, at least one of a center position, a diameter, and roundness of the ink dot is measured. By measuring the shape, it is possible to easily obtain the shape information of the dot of the reaction solution. The reaction solution dot shape information obtained by the measurement may be at least one of information about a center position and a diameter of a reaction solution dot. The above-described information is easily fed back to the reaction solution application step.

Though the position of the imaging unit 18 is illustrated as the position on the recording medium immediately after the transfer, the position is not limitative. When the recording medium is a roll paper, imaging of a paper sheet obtained by cutting off from the roll paper may be performed. By performing the imaging in the off-line state, it is no longer necessary to perform the high speed imaging, and it is therefore possible to measure the ink dot shape in the formed image with higher definition.

Figure 3:
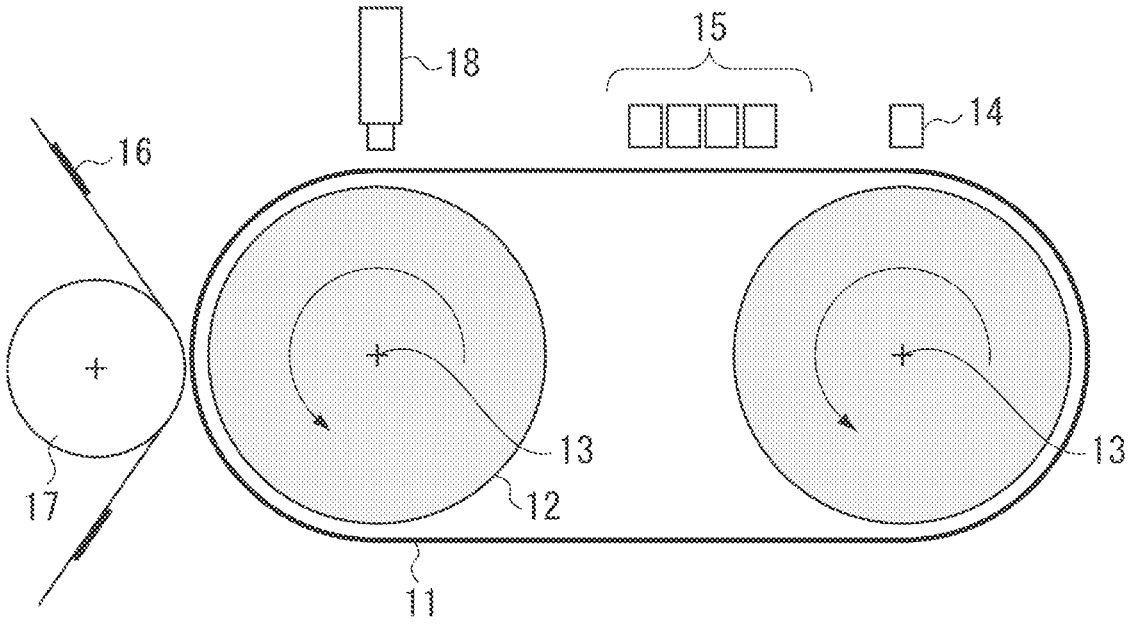
FIG. 3 is a diagram illustrating a transfer type inkjet recording apparatus.

Though the recording medium is imaged in FIG. 1, the imaging is not limitative, and the intermediate image formed on the intermediate transfer member 11 may be directly imaged as illustrated in FIG. 3, for example. By measuring the ink dot shape on the image forming surface of the intermediate transfer member, it is possible to evaluate the formed image eliminating an image change portion generated by the transfer, thereby making it possible to perform the ink dot shape measurement with higher accuracy.

The ink dot shape measurement will be described in more details. An ink dot image is extracted from color image data obtained by the imaging unit 18. As a method for the extraction, a method of extracting an image of specific ink dots by color filtering may be employed.

As the ink dot center position measurement method, the following method may be employed, for example. When the ink dot image is extracted, a median point of a pixel occupied by each of the ink dots is defined as the center position. By preliminary recognizing a position relationship between the inkjet head device 15 and the imaging unit 18, a position at which the image input data must be located is detected on the image data obtained by the imaging unit 18. Thus, a center position shift is detected from the ideal center position and the actual ink dot center position.

As the ink dot diameter calculation method, the following method may be employed, for example. 180 straight lines are drawn at an interval of 2 degrees (i.e. 360 degrees in total) from the center position determined by the above-described method to an ink dot outer periphery. The ink dot diameter is calculated by doubling an average value of lengths of the 180 straight lines from the center position to the dot.

The roundness of an ink dot may be determined by a value obtained by dividing a square value of a length of a periphery of the ink dot ($M<m^2>$) by an area ($S<m^2$) of the ink dot and a value obtained by quadruplicating the circumference ratio. In short, the roundness is $M/(S\times4\pi)$. The ink dot approximates to a true circle as the value approximates to 1.

The reaction solution dot shape information is obtained by comparing a result of the measurement of the shape of the ink dot obtained as described above to preliminary data information such as the pattern illustrated in FIG. 2, for example.

Hereinafter, a transfer type inkjet recording method for attaining satisfactory contact between a reaction solution and an ink and obtaining an ink dot having a predetermined shape by employing the reaction solution dot shape information obtainment method according to aspects of the present invention will be described. In the transfer type inkjet recording method, it may be the case that a method is employed wherein: data relating to the ink dot and the reaction solution dot are obtained preliminarily and the preliminary data and reaction solution dot shape information obtained by actual recording are compared to each other; and a comparison result is fed back to the reaction solution application.

Figure 4:
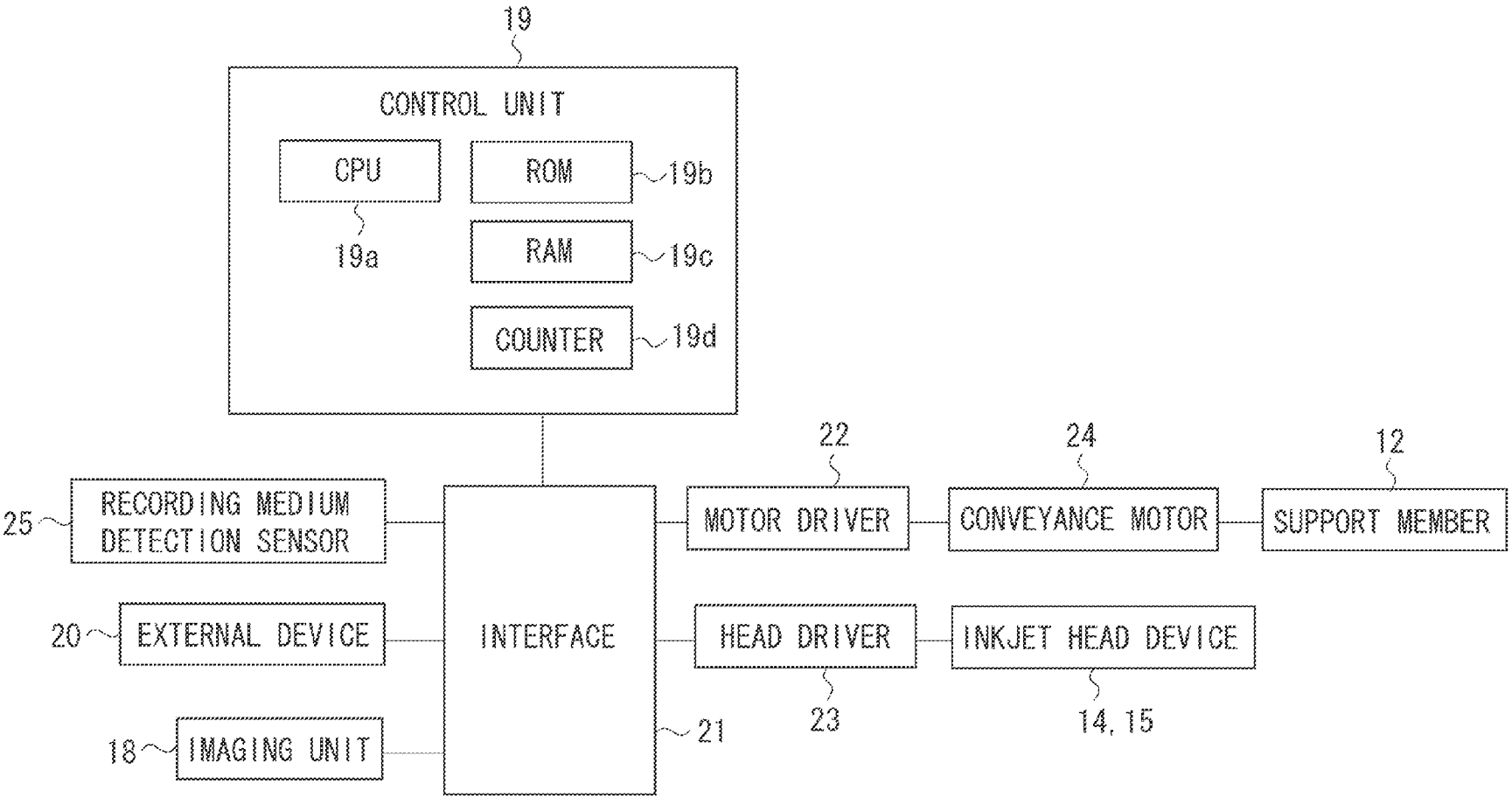
FIG. 4 is a control block diagram illustrating control contents.

A control unit that performs driving control of a transfer type inkjet recording apparatus will be described with reference to FIG. 4. FIG. 4 is a block diagram illustrating a control system. A control unit 19 that sends a driving control signal for each of units includes a central processing unit (CPU) 19*a*, a read-only memory (ROM) 19*b*, a random access memory (RAM) 10*c*, and a counter 19*d*. The CPU 19*a* is a central processing unit that reads a program and various pieces of data from the ROM 19*b* and the like to perform calculation and determination, thereby performing various types of control. The ROM 19*b* is a read-only-memory and stores various programs for operation of the CPU 19*a* and various pieces of data for character encoding, dot pattern recording, and the like. The RAM 19*c* is a read/write memory and is formed of a working area for temporarily storing data being used in the command of the CPU 19*a* and calculation result, a buffer area for storing various pieces of data input from an external device 20 or the like.

The preliminary data relating to the ink dot and the reaction solution dot is stored in the control unit 19. After determination is made by comparison between the preliminary data and reaction solution dot shape information obtained by actual recording, feed back is performed by sending a signal to a head driver 23 in such a manner that discharge amounts of the inkjet head devices 14 and 15 for discharging the reaction solution are changed. In this case, the control unit 19 is a feed back unit. The counter 19*d* counts the number of driving pulses or the like of a conveyance motor 24 for moving the support members 12 and transmits the information to the CPU 19*a*. Via a control interface 21, an image signal is input from the external device 20, a recording medium detection signal is input from a recording medium detection sensor 25, data of formed image or the like is input from the imaging unit 18. The control unit outputs the driving signal to a motor driver 22 for driving the conveyance motor 24 based on the program and outputs a driving signal to the head driver 23 for driving the inkjet head devices 14 and 15.

Figure 5A:
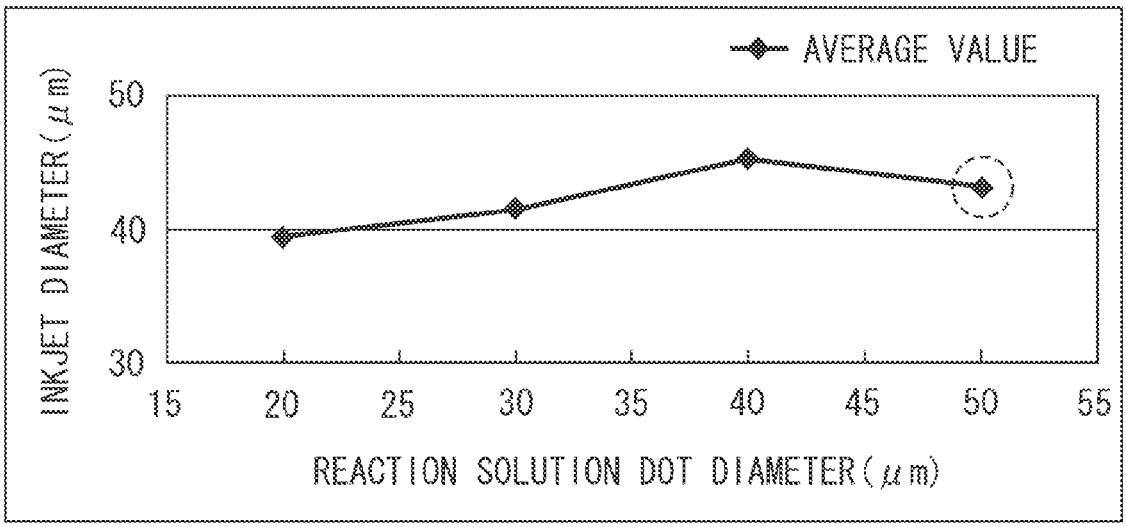
FIGS. 5A, 5B, and 5C are diagrams each illustrating a relationship between a reaction solution dot and an ink dot.
Figure 5B:
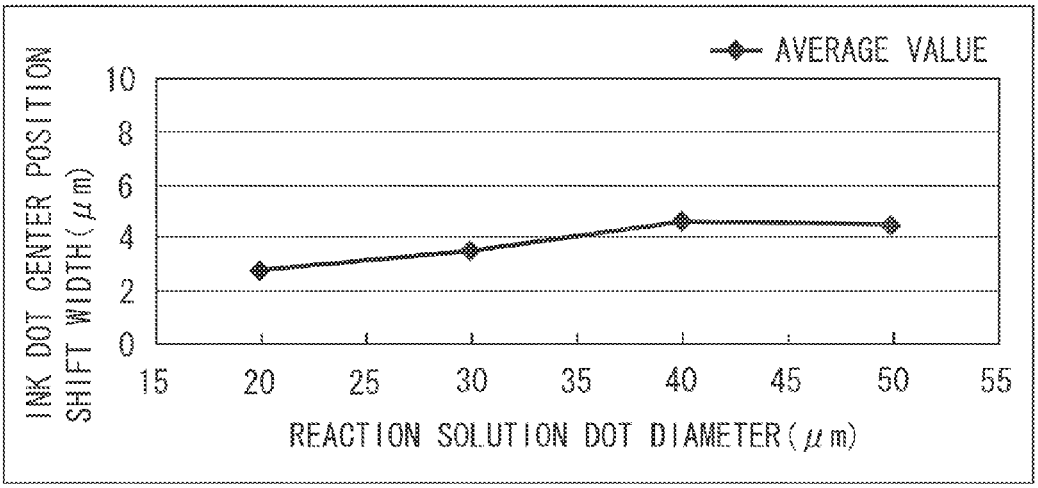
Figure 5C:
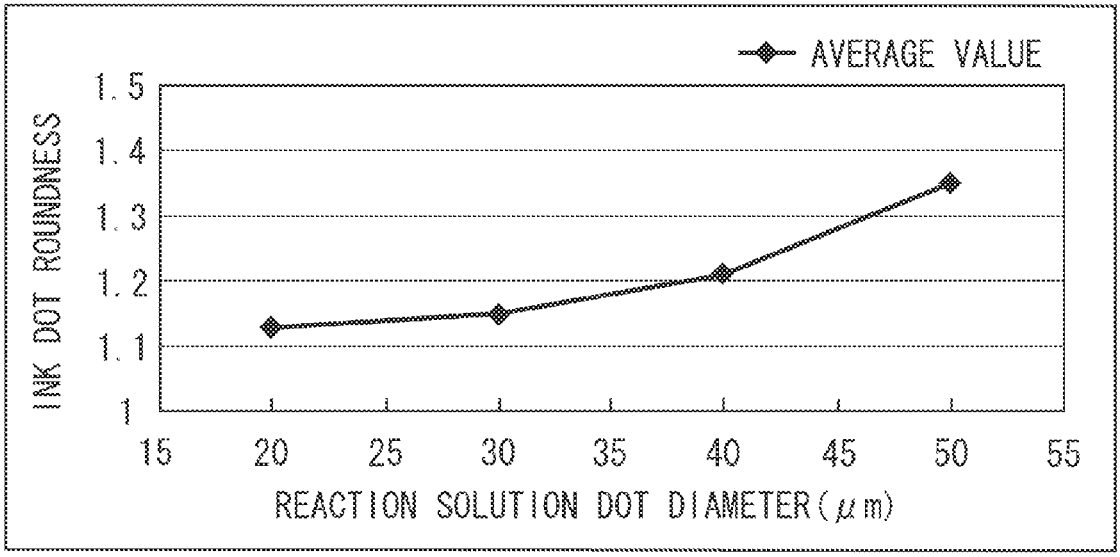

The method for obtaining the preliminary data will be described. For example, the ink and the reaction solution are applied with application amounts thereof being controlled by the inkjet head devices, and it is confirmed how an ink dot shape and an ink dot position change depending on a reaction solution dot diameter and a reaction solution dot position. The reaction solution dot applied to the image forming surface of the intermediate transfer member includes fluctuations in the process steps. There are fluctuations in a coating position and amount, and the ink discharged on the reaction solution includes similar fluctuations. Therefore, in the reaction between the reaction solution and the ink, there are dots in contact with each other in which the distance between centers is 0 or their centers are away from each other. As a result, the ink dot shape and position shift in a formed image includes fluctuations. Alternatively, a maximum value and a minimum value of the data having the fluctuations may be used in place of the average value. Average values of the parameters of the roundness, diameter, and center position shift are illustrated in FIGS. 5A to 5C. As indicated by Condition (b)-(1) of FIG. 2, when the reaction solution dot diameter is larger than the ink dot diameter by a certain degree, the diameter of the ink dot landed on the reaction solution dot becomes smaller than that of an ordinary state. The portion enclosed by a broken line in FIG. 5A has the smaller average value of the ink dot diameters and matches with the result illustrated in FIG. 2. The correlation between the reaction solution dot diameter and the ink dot data fluctuation is stored in a storage area of the apparatus. Further, threshold values of the ink dot shape and position shift in a formed image are set depending on a target specification of a printed matter and stored in the memory region.

Figure 6:
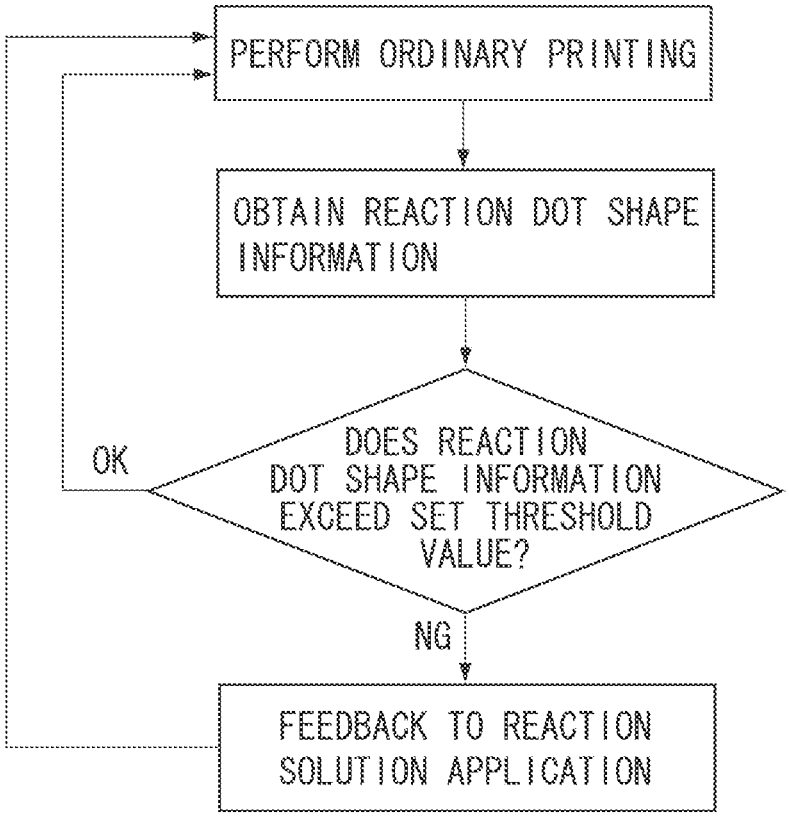
FIG. 6 is a diagram illustrating a printing flow.

After obtaining the preliminary data, ordinary printing is performed for a certain period of time or for a certain number of paper sheets as illustrated in FIG. 6. A printing quantity is confirmed using the counter 19*d* illustrated in FIG. 4. After performing the ordinary printing for the predetermined number of paper sheets, shapes of ink dots are measured, and the measured ink dot shapes are compared with the preliminary data stored in the storage area, thereby obtaining the reaction solution dot shape information. Further, the obtained reaction solution dot shape information is compared to the threshold values stored in the storage area, thereby determining whether to return to the ordinary printing or to feedback to the reaction solution application. In FIG. 6, the processing returns to the ordinary printing when the obtained reaction solution dot shape information does not exceed the threshold values (OK), and the feedback to the reaction solution application is performed when the obtained reaction solution dot shape information exceeds the threshold values (NG).

As described above, when the obtained reaction solution dot shape information exceeds the threshold values stored in the storage area, the feedback to the reaction solution application is performed by the feedback unit. The fluctuations in ink dots are suppressed by changing an application amount and an application position of the reaction solution applied to the intermediate transfer member based on the feedback. For example, the application amount of the reaction solution is changed by employing a method of increasing and decreasing the number of dots discharged from the same nozzle. Alternatively, nozzles of various sizes are provided in advance of the application amount change, and the large nozzle is selected for increasing the application amount, and the small nozzle is selected for reducing the application amount. When the reaction solution application is performed by a gravure offset roller, for example, the application amount is changed by adjusting a contact angle of a squeegee for scraping off cells. According to aspects of the present invention, it may be the case that the reaction solution is applied by the inkjet recording method since the inkjet recording method can be conveniently performed in which the application amount is controlled and the application position is easily adjusted by selecting the number of discharged dots and the discharge nozzle shape.

According to aspects of the present invention, it is possible to obtain preliminary data for each of combinations of a surface state of the intermediate transfer member, the reaction solution, and the ink to compare the preliminary data to the results obtained by an actual apparatus. Also, in an image in which the dots are connected, a reaction caused at the instant of landing of each of the ink dots is considered to be the same as the reaction of a single dot. Therefore, it is possible to perform stable image formation for the image in which the ink dots are connected by optimizing the reaction solution application amount according to aspects of the present invention.

As described above, the inventors found that the reaction solution dot shape information obtainment method according to aspects of the present invention is so effective for the requirements of the transfer type inkjet recording method. The reaction solution dot shape information obtainment method according to aspects of the present invention is applicable to a direct drawing type ink jet recording method in which an ink is directly applied onto a recording medium such as a paper sheet. In the case of the application to the method, an ink dot shape of an image transferred onto the recording medium is measured, and reaction solution dot shape information is obtained from the ink dot shape measurement result.

Hereinafter, aspects of the present invention will more specifically be described in conjunction with an example. In the present exemplary example, a transfer type inkjet recording apparatus same as that illustrated in FIG. 1 was used. As the support member 12, a columnar member made from an aluminum alloy was used in view of characteristics such as rigidity that can endure pressure during transfer and dimension accuracy. The following intermediate transfer member 11 was used. A PET sheet having a thickness of 0.5 mm was coated with a silicon rubber (KE 12 manufactured by Shin-Etsu Chemical Co., Ltd.) having a thickness of 0.2 mm and a rubber hardness of 40 degrees. A surface modification was performed on a surface of the coating using an atmospheric plasma treatment device. Further, the treated surface was dipped into an aqueous surfactant solution, followed by washing and drying, thereby obtaining the intermediate transfer member 11. The intermediate transfer member 11 is fixed to a belt with a double-sided adhesive tape.

First, preliminary data was obtained using the transfer type inkjet recording apparatus. The intermediate transfer member was in a surface energy state that causes an ink dot diameter to be 40 μm when an ink having the following composition and a droplet volume of 4 pl lands onto the intermediate transfer member.

(Ink Composition)

Carbon black (MCF88 manufactured by Mitsubishi Chemical Corporation): 3 parts by mass Styrene-acrylic acid-ethyl acrylate copolymer (acid value: 180, weight average molecular weight: 400): 1 part by mass Glycerin: 10 parts by mass Ethyleneglycol: 5 parts by mass Surfactant (Acetylenol EH manufactured by Kawaken Fine Chemicals Co., Ltd.): 1 part by mass Ion exchange water: 80 parts by mass Firstly, a reaction solution having the following composition and a droplet volume of 1 pl was applied on one part for a plurality of times to control a reaction solution dot diameter, and a test was conducted. The application of the reaction solution was performed at an interval of 1200 dpi using a device for performing ink discharge by using an electrothermal converter and an on-demand method.

(Reaction Solution Composition)

$Mg(NO_3)2.6H_2O$: 7 parts by mass

Surfactant (Acetylenol EH manufactured by Kawaken Fine Chemicals Co., Ltd.): 1 part by mass Diethylene glycol: 20 parts by mass Hexylene glycol: 10 parts by mass Pure water: 62 parts by mass The reaction solution dot diameter was controlled to 20 μm, 30 μm, 40 μm, and 50 μm. The reaction solution dot diameter was measured at a stationary state using a three-dimensional non-contact type surface shape measurement system employing optical interferometry.

The ink of the above-specified composition was applied on an entire image forming surface of the intermediate transfer member in a pattern of discharging on the central dot among 9 dots (3×3 dots) using the same device used for the reaction solution application in printing resolution of 1200 dpi.

An intermediate image was formed on the image forming surface of the intermediate transfer member as described above, and the image forming surface of the intermediate transfer member was press-fixed to a recording medium (basis weight: 127.9 g/m$^2$, Aurora Coat manufactured by Nippon Paper Group, Inc.), thereby forming an image on the recording medium.

In the present exemplary example, reaction solution dot shape information was obtained from a measurement result of ink dot shapes in a certain area as the preliminary data. More specifically, average value data was obtained by dividing into sections each having 256 dots (16×16 dots). In the preliminary data of the present exemplary example, a reaction solution dot diameter value was set to 30 μm, and a threshold value for determination was set to 30±5 μm. The ranges were determined by visually confirming that irregularity was generated in the image when the values exceed the ranges.

Next, ordinary printing was performed using the transfer type inkjet recording apparatus. The reaction solution having the above-specified composition was applied at an interval of 1200 dpi onto a region in which the ink will be applied on the image forming surface of the intermediate transfer member using the above-described device and employing the inkjet recording method. Subsequently, the ink having the above-specified composition was applied onto the image forming surface of the intermediate transfer member using the above-described device and employing the inkjet recording method, thereby forming an intermediate image. The image forming surface of the intermediate transfer member on which the intermediate image was formed as described above was press-fixed to a recording medium (basis weight: 127.9 g/m$^2$, Aurora Coat manufactured by Nippon Paper Group, Inc.), thereby forming an image on the recording medium.

In the present exemplary example, ink dot shapes were measured after printing 5000 sheets of A4 paper. The ink dot shape measurement was performed by imaging using a lens capable of ×50 optical magnification with an imaging range of 0.6×0.8 mm and a resolution of 1200×1600 pixels.

Reaction solution dot shape information was obtained by comparing the ink dot shape measurement result to the preliminary data. As a result, it was determined from an ink dot diameter that a reaction solution dot diameter was 32 μm in the vicinity of the center in a recording medium conveyance direction (within a radius of 1 cm from the center). Likewise, it was determined that a reaction solution dot diameter was 23 μm at each of both ends in the conveyance direction (within 2 cm from each of the both ends). In the present example, the threshold value for the reaction solution dot diameter was set in the range within 30±5 μm, and the reaction solution dot diameters at the both ends in the conveyance direction exceeded the threshold value. In the present exemplary example, the reaction solution application unit is the inkjet head device. Therefore, the application amount was adjusted in such a manner that the number of discharged dots from each of the nozzles in the inkjet head device is increased for the purpose of increasing an application amount at the both ends. As a result of the feedback, a prominent effect of suppressing the ink dot diameter fluctuation at the both end parts and the central part was attained. According to aspects of the present invention, it is possible to favorably obtain the reaction solution dot shape information on the intermediate transfer member.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-057727 filed Mar. 15, 2010, which is hereby incorporated by reference herein in its entirety.

What is claimed is:

1. A transfer type inkjet recording method, comprising:

applying a reaction solution to aggregate a color material component contained in an ink onto an image forming surface of an intermediate transfer member;

forming an intermediate image by applying the ink containing the color material component onto the image forming surface of the intermediate transfer member onto which the reaction solution is applied; and transferring the intermediate image from the image forming surface to a recording medium by pressing the recording medium to the image forming surface on which the intermediate image is formed;

obtaining information of an ink dot of the intermediate image formed on the image forming surface of the intermediate transfer member or the image transferred onto the recording medium; and feeding back the obtained information of the ink dot to the reaction solution application, wherein at least one of an application amount to the intermediate transfer member and an application position of the reaction solution is changed based on the feeding back to the reaction solution application in the feedback.

2. The transfer type inkjet recording method according to claim 1, wherein the information of the ink dot is obtained by measuring at least one of a center position, a diameter, and roundness of the ink dot.

3. A transfer type inkjet recording apparatus, comprising:

a reaction solution application unit that applies a reaction solution to aggregate a color material component contained in an ink onto an image forming surface of an intermediate transfer member;

an ink application unit that forms an intermediate image by applying the ink containing the color material component onto the image forming surface of the intermediate transfer member onto which the reaction solution is applied; and a transfer unit that forms an image by transferring the intermediate image from the image forming surface to a recording medium by pressing the recording medium to the image forming surface on which the intermediate image is formed, comprising:

a feedback unit that obtains information of an ink dot of the intermediate image formed on the image forming surface of the intermediate transfer member or the image transferred onto the recording medium; and feeds back the obtained information of the ink dot to the reaction solution application, wherein at least one of an application amount to the intermediate transfer member and an application position of the reaction solution is changed based on the feedback to the reaction solution application.

4. The transfer type inkjet recording apparatus according to claim 3, wherein the information of the ink dot is obtained by measuring at least one of a center position, a diameter, and roundness of the ink dot.

* * * * *